US008228318B2

(12) United States Patent
Lo

(10) Patent No.: US 8,228,318 B2
(45) Date of Patent: Jul. 24, 2012

(54) FRAME BUFFER APPARATUS AND RELATED FRAME DATA RETRIEVING METHOD

(75) Inventor: Jui-Lin Lo, Tainan County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 955 days.

(21) Appl. No.: 11/829,083

(22) Filed: Jul. 26, 2007

(65) Prior Publication Data

US 2009/0002350 A1 Jan. 1, 2009

(30) Foreign Application Priority Data

Jun. 28, 2007 (TW) ..... 96123488 A

(51) Int. Cl.
*G09G 5/00* (2006.01)

(52) U.S. Cl. ..... 345/204; 345/209; 345/54; 345/96

(58) Field of Classification Search ..... 345/204, 345/209, 54, 96
See application file for complete search history.

(56) References Cited

U.S. PATENT DOCUMENTS 6,624,800 B2 * 9/2003 Hughes et al. ..... 345/88
2004/0017343 A1 * 1/2004 Adachi et al. ..... 345/87
2005/0231655 A1 * 10/2005 Pasqualini et al. ..... 349/36
2006/0017713 A1 * 1/2006 Lee et al. ..... 345/204
2006/0208960 A1 * 9/2006 Glen ..... 345/3.1
2007/0279374 A1 * 12/2007 Kimura et al. ..... 345/102

FOREIGN PATENT DOCUMENTS

CN 1729504 A 2/2006
TW 200705348 2/2007
TW 200715242 4/2007

* cited by examiner

*Primary Examiner* — Yong H Sim

(74) *Attorney, Agent, or Firm* — Winston Hsu; Scott Margo

(57) ABSTRACT

A frame buffer apparatus is disclosed. The frame buffer apparatus includes a hold-type display for displaying and holding previous frame data; a data reading device for reading back the previous frame data held in the hold-type display. A driving circuit for a hold-type display is also disclosed. The data driving circuit for a hold-type display includes a video data input terminal for receiving video data; a driving voltage output terminal for outputting a driving voltage to a display panel of the hold-type display; a sample and hold unit for sampling and holding voltages of the driving voltage output terminal to generate a sampled voltage according to a sampling signal; and a driving voltage generation unit for performing signal processing for the video data to output the driving voltage according to a plurality of reference voltages, a polarity selection signal and the sampled voltage.

19 Claims, 8 Drawing Sheets

FRAME BUFFER APPARATUS AND RELATED FRAME DATA RETRIEVING METHOD

BACKGROUND OF THE INVENTION

1. Field of the Invention

The present invention relates to a frame buffer apparatus and related frame data retrieving method, and more particularly, to an apparatus and method directly utilizing a hold-type display panel as a frame buffer by reading back pixel voltages of the hold-type display panel.

2. Description of the Prior Art

Compared with impulse-type driving methods of traditional cathode ray tube (CRT) displays, hold-type displays like liquid crystal displays (LCDs), usually suffer from slow response time problem, and thus motion blur phenomenon often occurs when motion picture are displayed. In order to speed up the response speed of LCDs and achieve better image quality as well, some image processing techniques, such as over-driving, de-interlacing, motion compensation, and frame rate conversion, are wildly applied in current products. However, the above-mentioned image processing techniques usually need to store at least one frame data for image processing to generate video data of a next output image frame. Therefore, in the prior art, the display system must use memories like dynamic random access memory (DRAM) or static random access memory (SRAM) as a frame buffer for storing the frame data.

Please refer to FIG. 1. FIG. 1 is a diagram of a video data processor 10 of a display according to the prior art. The video data processor 10 is coupled between a video source (not shown in FIG. 1) and a display system 130. As shown in FIG. 1, the video data processor 10 includes a memory 100, a memory control unit 110 and a data processing unit 120. The memory 100 is utilized as a frame buffer for storing image data of previous image frames; the memory control unit 110 is utilized for controlling access to the memory 100; and the data processing unit 120 is utilized for performing calculations such as over-driving, de-interlacing, motion compensation or frame rate conversion to output image data to the display system 130 according to the image data stored in the memory 100 and currently received video data. Thus, the display system 130 can output driving voltages for displaying corresponding images according to the image data outputted by the video data processor 10.

Please further refer to FIG. 2. FIG. 2 is a schematic diagram of the display system 130 of a hold-type display according to the prior art. The display system 130 includes a display panel 131, a control circuit 132, a data driving circuit 133 and a scan circuit 134. The control circuit 132 is utilized for generating corresponding control signals to respectively output to the data driving circuit 133 and the scan circuit 134 with respect to a horizontal synchronization signal 135 and a vertical synchronization signal 136. According to the control signals generated by the control circuit 132, the scan circuit 134 can turn on each scan line of the display panel 131 in order, and the data driving circuit 133 can output the driving voltages to the display panel 131 for controlling brightness status of corresponding pixels further according to image data 137 generated by the above-mentioned video data processor 10, so as to display corresponding images.

Therefore, in the prior arts, in order to achieve the specific image processing function, the hold-type displays must have extra memories as the frame buffer for storing corresponding frame data, so that the cost of such a display system will be more expensive.

SUMMARY OF THE INVENTION

It is therefore a primary objective of the present invention to provide a method of using a hold-type display as a frame buffer and related apparatus thereof, to solve the above-mentioned problem.

The present invention discloses a data driving circuit for a hold-type display. The data driving circuit includes a video data input terminal for receiving video data; a driving voltage output terminal for outputting a driving voltage to the hold-type display; a sample and hold unit coupled to the driving voltage output terminal for sampling and holding voltage of the driving voltage output terminal to generate a sampled voltage according to a sampling signal; and a driving voltage generation unit, coupled to the video data input terminal, the driving voltage output terminal and the sample and hold unit, for performing signal processing for the video data to output the driving voltage according to a plurality of reference voltages, a polarity selection signal and the sampled voltage.

The present invention further discloses a driving method for a hold-type display. The driving method includes receiving video data; sampling and holding voltages of a driving voltage output terminal to generate a sampled voltage according to a sampling signal; performing signal processing for the video data to output a driving voltage according to a plurality of reference voltages, a polarity selection signal and the sampled voltage; and outputting the driving voltage to the hold-type display.

The present invention further discloses a method for retrieving frame data. The method includes displaying frame data of a previous frame by a hold-type display; and reading back the frame data held in the hold-type display.

The present invention further discloses a frame buffer apparatus. The frame buffer apparatus includes a hold-type display for displaying and holding frame data of a previous frame; and a data reading device, coupled to the hold-type display, for reading back the frame data held in the hold-type display.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
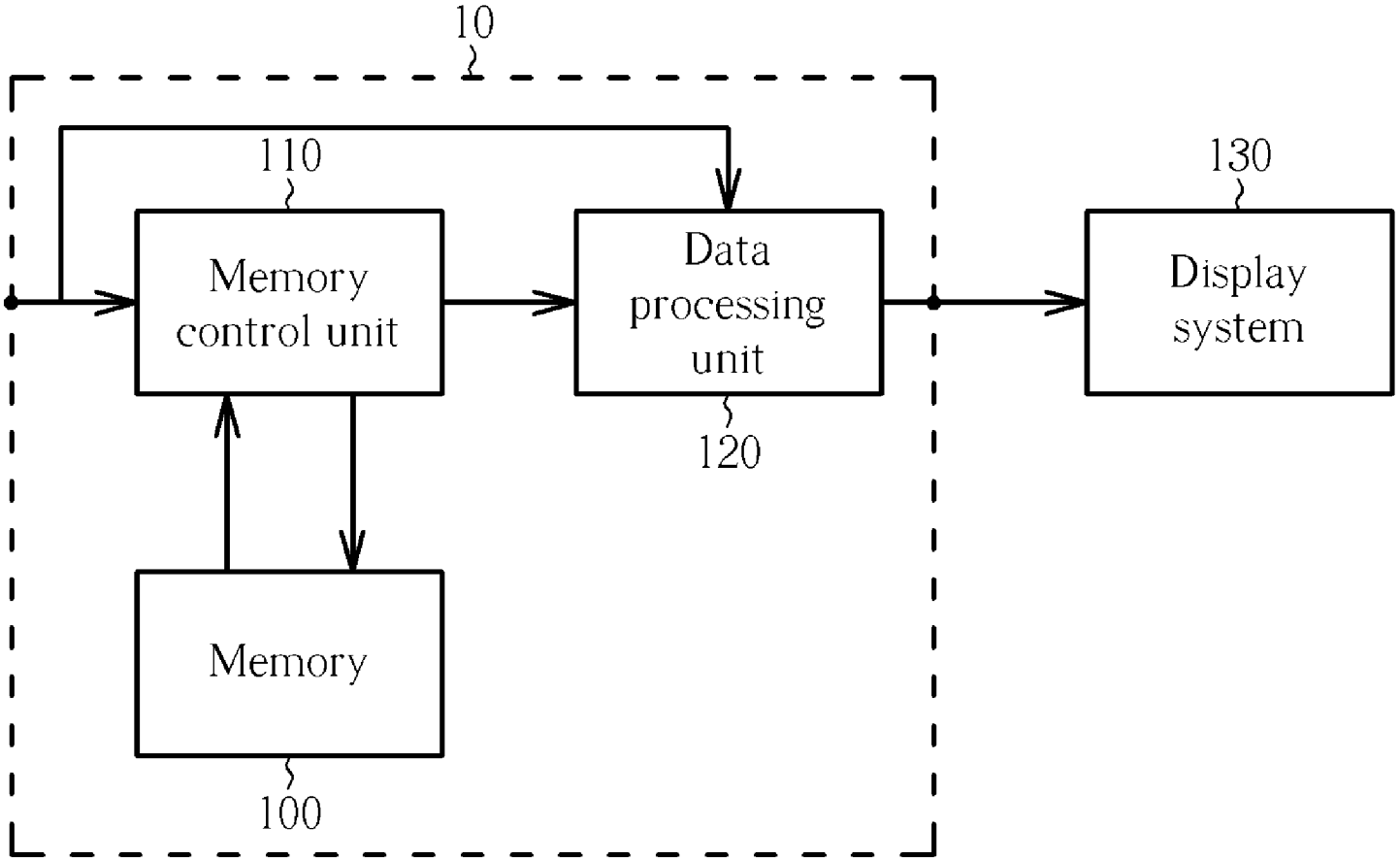
Fig. 1 Prior Art
FIG. 1 is a diagram of a video data processor of a display according to the prior art.
Figure 2:
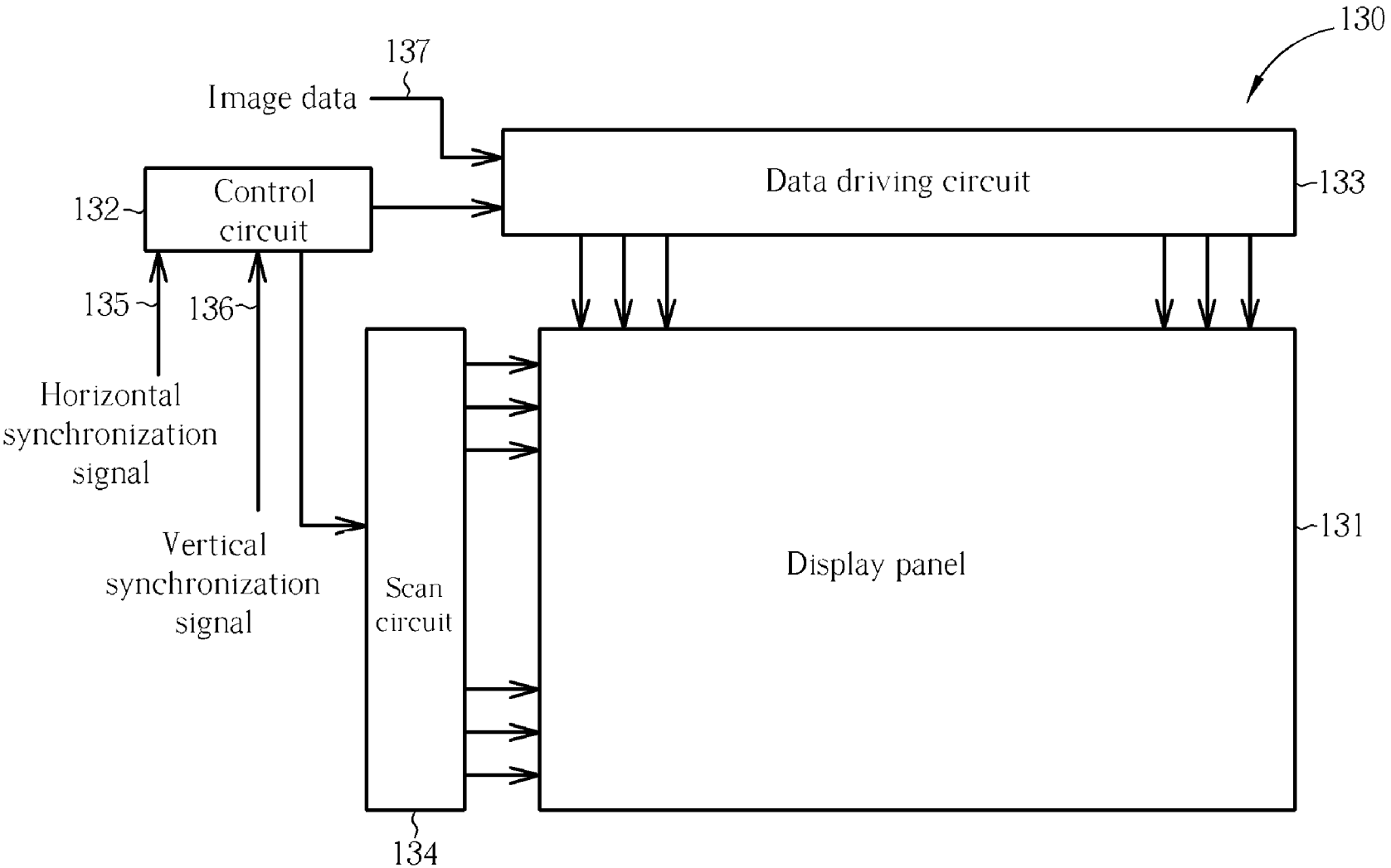
Fig. 2 Prior Art
FIG. 2 is a diagram of a display system of the display shown in FIG. 1.
Figure 3:
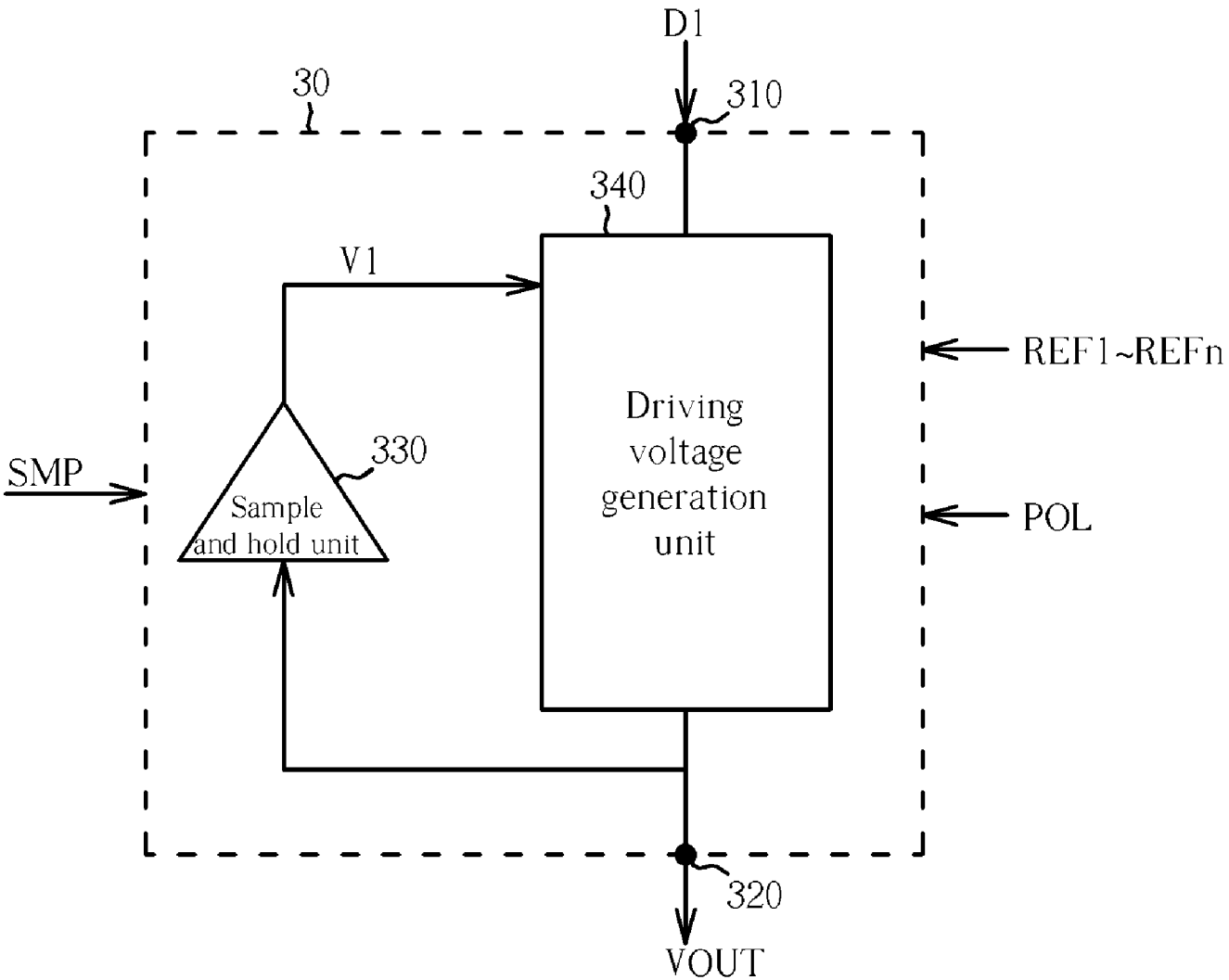
FIG. 3 is a schematic diagram of a data driving circuit for a hold-type display according to the present invention.

Please refer to FIG. 3. FIG. 3 is a block diagram of a data driving circuit 30 for a hold-type display according to the present invention. The data driving circuit 30 includes a video data input terminal 310, a driving voltage output terminal 320, a sample and hold unit 330 and a driving voltage generation unit 340. The video data input terminal 310 is utilized for receiving video data D1. The driving voltage output terminal 320 is utilized for outputting a driving voltage VOUT to a display panel of the hold-type display. The sample and hold unit 330 is coupled to the driving voltage output terminal 320 and is utilized for sampling and holding voltages of the driving voltage output terminal 320 to generate a sampled voltage V1 according to a sampling signal SMP. Please note, the sampled voltage V1 is sampled when VOUT is not driven by the driving voltage generation unit 340. The driving voltage generation unit 340 is coupled to the video data input terminal 310, the driving voltage output terminal 320 and the sample and hold unit 330, and is utilized for performing signal processing for the video data D1 to output the corresponding driving voltage VOUT according to reference voltages REF1~REFn, a polarity selection signal POL and the sampled voltage V1.

Note that, the frame data of a previous image frame is still stored in the hold-type display before the next image frame is displayed. Taking a liquid crystal display for example, the frame data of the previous image frame will be stored in internal capacitors of a panel in the form of voltages, and thus the present invention can utilize the sample and hold unit 330 to read back the frame data stored in the hold-type display before the next image frame is displayed. Therefore, because the previous frame data is held in the hold-type display until the next image is displayed, the present invention can retrieve the frame data of the previous frame by sampling and holding the voltages of the driving voltage output terminal 320. In other words, the display panel of the hold-type display is used as a frame buffer in this embodiment. Therefore, the size of the frame memory can be reduced. In the present invention, the extra cost of frame data buffer can be relieved.

Figure 4:
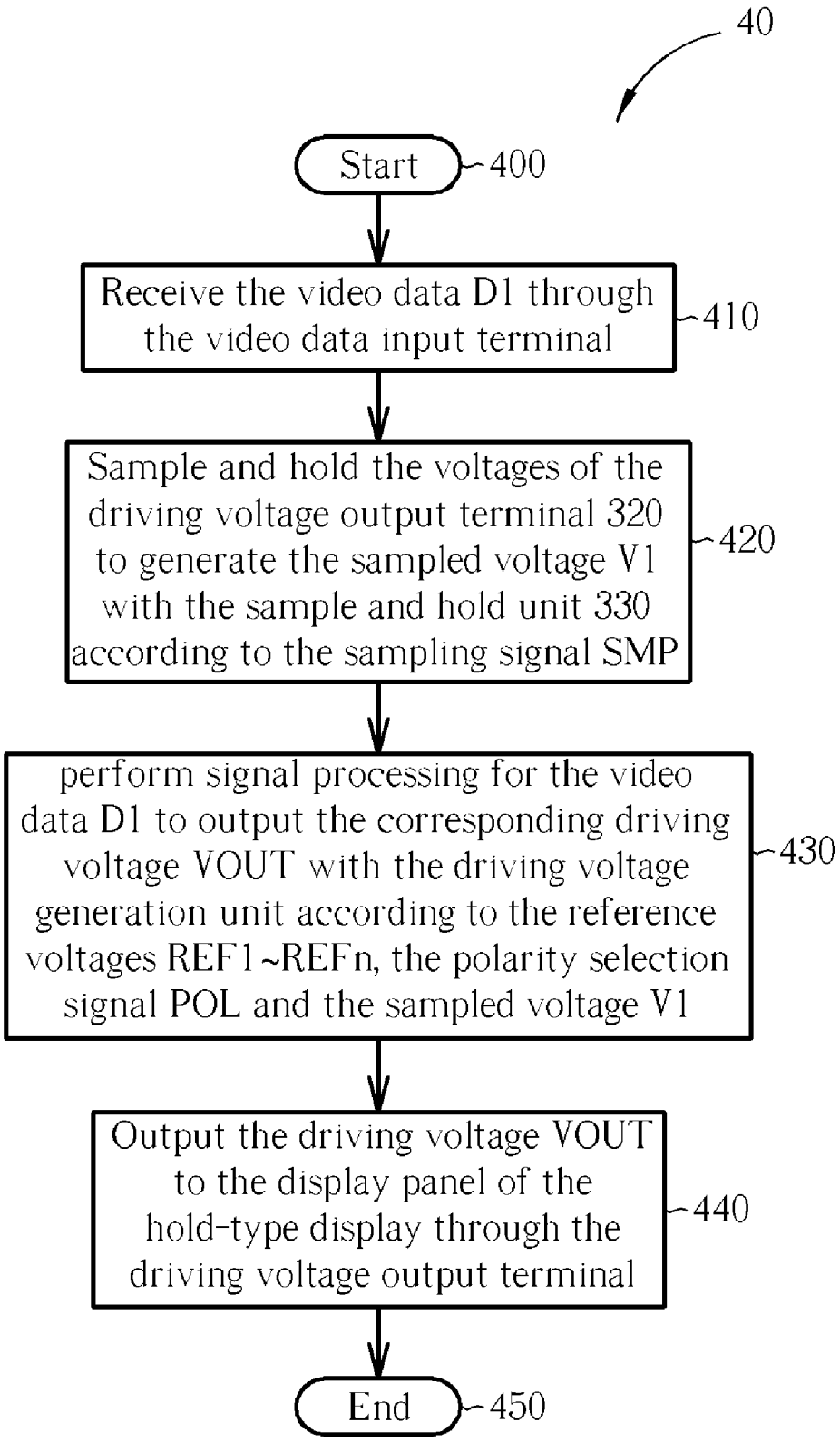
FIG. 4 is a flow chart of a process for a data driving circuit of the present invention.

As for operations of the data driving circuit 30, please further refer to FIG. 4. FIG. 4 is a flow chart of a process 40 for the data driving circuit 30 of the present invention. The process 40 includes the following steps:

Step 400: start.

Step 410: receive the video data D1 through the video data input terminal 310.

Step 420: sample and hold the voltages of the driving voltage output terminal 320 to generate the sampled voltage V1 with the sample and hold unit 330 according to the sampling signal SMP.

Step 430: perform signal processing for the video data D1 to output the corresponding driving voltage VOUT with the driving voltage generation unit 340 according to the reference voltages REF1~REFn, the polarity selection signal POL and the sampled voltage V1.

Step 440: output the driving voltage VOUT to the display panel of the hold-type display through the driving voltage output terminal 320.

Step 450: end.

Therefore, according to the process 40, the present invention firstly receives the video data D1 through the video data input terminal 310, and then the sample and hold unit 330 will sample and hold the voltages of the driving voltage output terminal 320 to generate the sampled voltage V1 according to the sampling signal SMP, so that the driving voltage generation unit 340 can perform some signal processing operations like over-driving, de-interlacing, motion compensation or frame rate conversion for the video data D1 to output the corresponding driving voltage VOUT to the display panel according to the sampled voltage V1, the reference voltages REF1~REFn, and the polarity selection signal POL.

Figure 8:
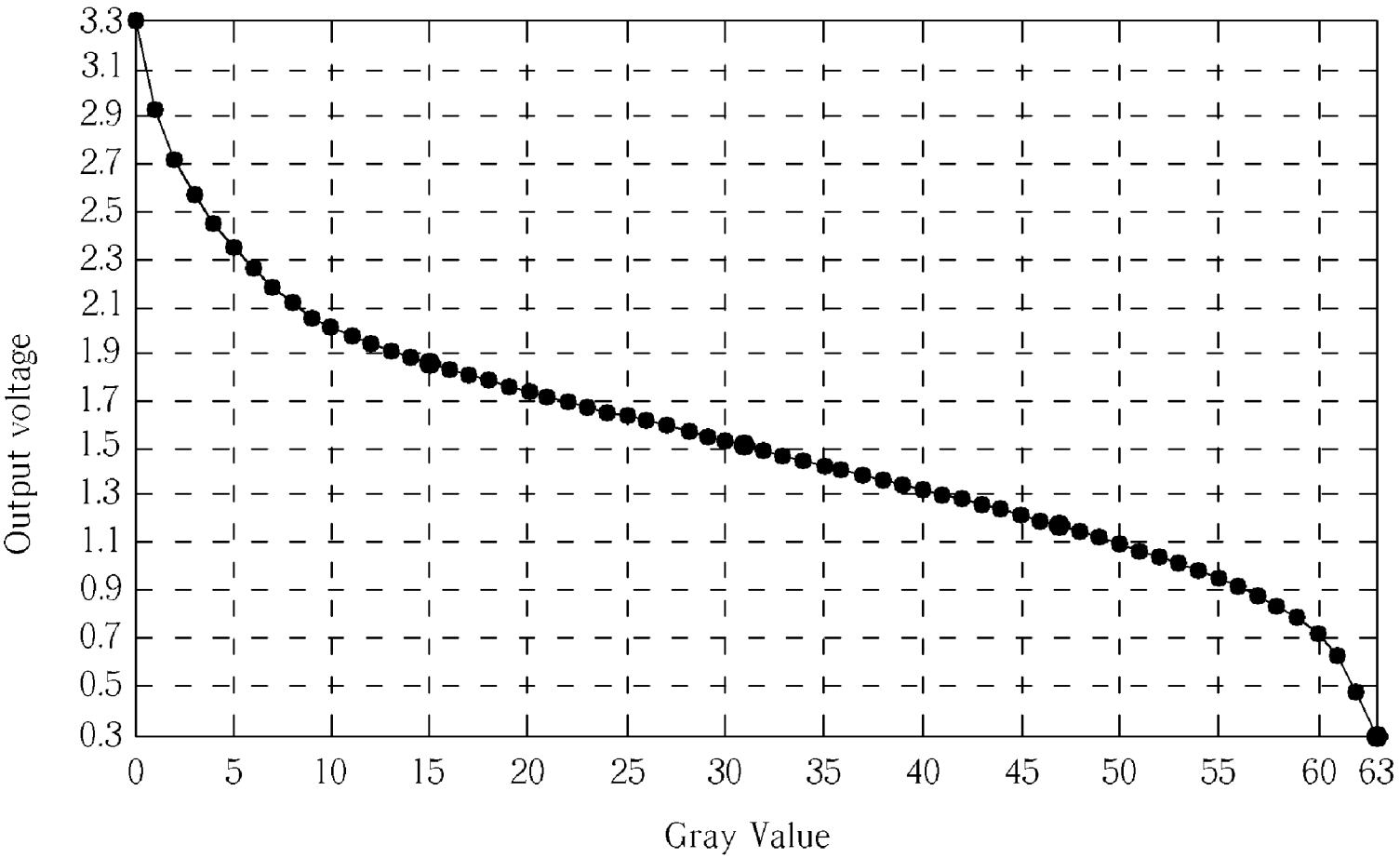
FIG. 8 is a schematic diagram of a Gamma curve.

Please note that, in order to utilize the display panel as the frame buffer, the data driving circuit 30 has to read back the current pixel voltages of the display panel (i.e. the voltages of the driving voltage output terminal 320) before outputting the next driving voltage VOUT. For example, the present invention can sample the pixel voltages of the display panel when the voltage level of the sampling signal SMP is high. At this time, the driving voltage generation unit 340 stops outputting the driving voltage VOUT, and the sampled voltage V1 outputted by the sample and hold unit 330 varies with the pixel voltage of the display panel. Conversely, when the voltage level of the sampling signal SMP is switched low, the sample and hold unit 330 holds and outputs the sampled voltage V1. Thus, the driving voltage generation unit 340 can then perform the signal processing operation on the current video data D1 to output the corresponding driving voltage VOUT according to the sampled voltage V1, the reference voltages REF1~REFn and the polarity selection signal POL. Such mechanism can be easily accomplished by those skilled in the art, for example, circuit designers can divide each driving period of a gate driving signal into two phases: one phase is utilized for the sample and hold unit 330 to sample the data of the previous frame from the display panel, and the other phase is then utilized for allowing the driving voltage generation unit 340 performing the signal processing operation to output the corresponding driving voltage VOUT for driving the display panel according to the data retrieved from the hold-type display and the current frame data. The sampling signal SMP and the polarity selection signal POL can be generated by a control circuit of the hold-type display (not shown in FIG. 3) such as a timing controller, and the reference voltages REF1~REFn can be generated according to a Gamma curve as shown in FIG. 8. The sampling signal can also be generated inside the data driving circuit 30 as long as the Vout can be sampled while it is not driven by the driving voltage generation unit 340 and the sampled voltage is held during the rest of the time.

Besides, operations like utilizing the driving voltage generation unit 340 for performing signal processing can be easily accomplished by those skilled in the art as well. For example, the present invention can compare the sampled voltage V1 of the frame data of the previous image frame with the current video data D1 for calculating an over-driving voltage information needed by the current image frame by utilizing a calculation unit of the driving voltage generation unit 340 (not shown in FIG. 3), and thus the corresponding driving voltage VOUT can be outputted.

Figure 5:
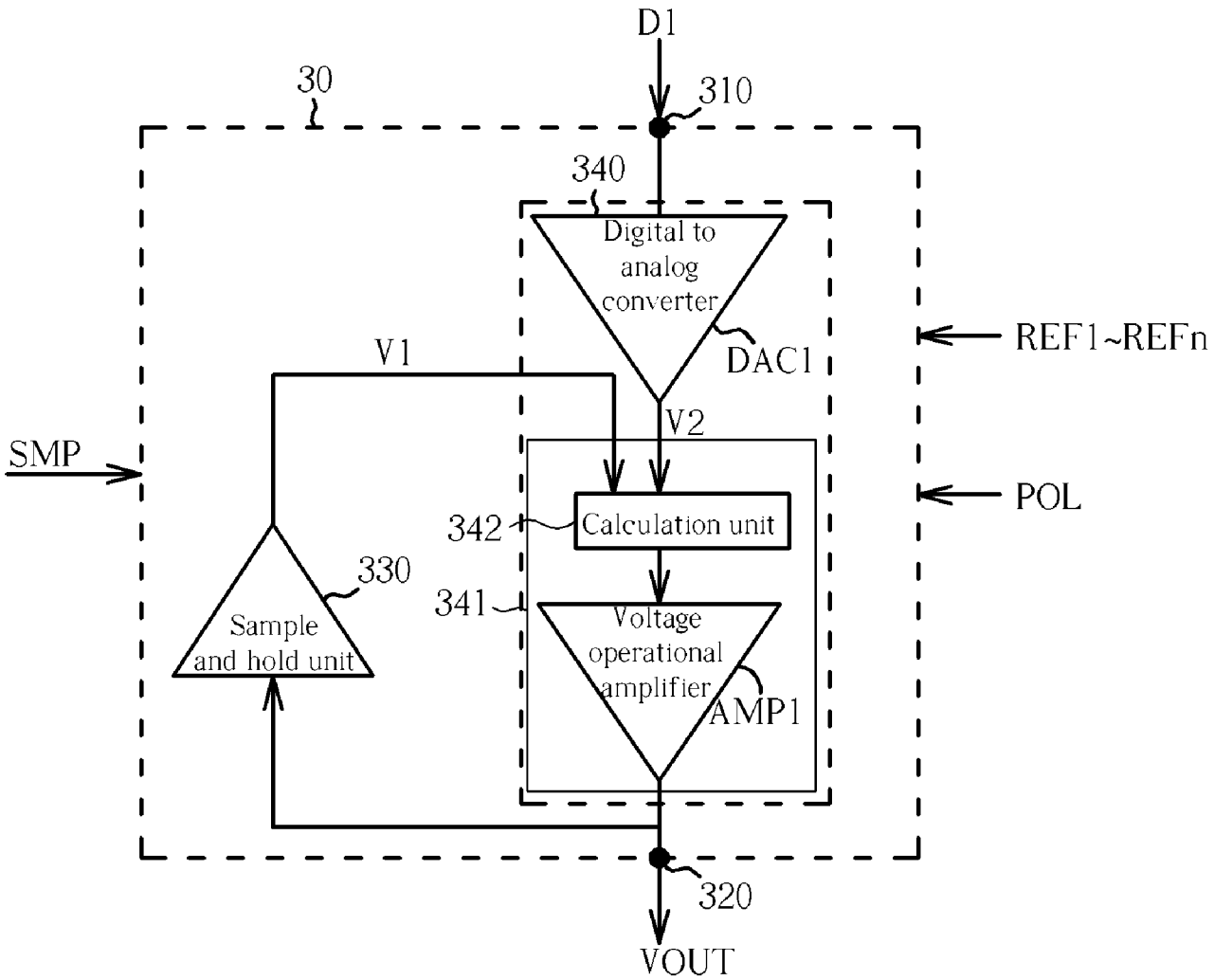
FIG. 5 is a schematic diagram of an embodiment of a data driving circuit of the present invention.

Please refer to FIG. 5. FIG. 5 is a schematic diagram of an embodiment of the data driving circuit 30 of the present invention. As shown in FIG. 5, the driving voltage generation unit 340 includes a digital-to-analog converter DAC1 and a signal processing module 341. The digital-to-analog converter DAC1 is coupled to the video data input terminal 310, and is utilized for converting the video data D1 to a second voltage V2 in analog form according to the reference voltages REF1~REFn. The signal processing module 341 is coupled to the digital-to-analog converter DAC1, the sample and hold unit 330 and the driving voltage output terminal 320, and includes a calculation unit 342 and a voltage operational amplifier AMP1. The calculation unit 342 is utilized for performing signal processing for the second voltage V2 according to the polarity selection signal POL and the sampled voltage V1 generated by the sample and hold unit 330. The voltage operational amplifier AMP1 is utilized for buffering and amplifying the result outputted by the calculation unit 342 to generate the corresponding driving voltage VOUT. As well known by those skilled in the art, the circuit structure of the driving voltage generation unit 340 of the present invention is similar to that in the prior art. The difference is that the signal processing module 341 not only can change the polarity of the outputted driving voltage VOUT according to the polarity selection signal POL, but also can perform some specific processing operations such as over-driving, de-interlacing, motion compensation or frame rate conversion for the second voltage V2 according to the sampled voltage V1 outputted by the sample and hold unit 330. Preferably, the calculation unit 342 can further be utilized for converting the polarity of the sampled voltage V1 to the same polarity as the second voltage V2 according to the polarity selection signal POL.

For example, the calculation unit 342 can convert the sampled voltage V1 into a voltage V1' having the same polarity as the second voltage V2 in advance according to the polarity selection signal POL. In this case, the calculation unit 342 can perform corresponding signal processing for the second voltage V2 according to the voltage V1' to output the corresponding driving voltage VOUT through the voltage operational amplifier AMP1. For example, when performing over-driving, the calculation unit 342 can output the driving voltage VOUT through the voltage operational amplifier AMP1 according to the following formula: VOUT=V2+K (V2−V1'), among which K can be a predetermined constant or a changing value varying with the voltage V1' and the second voltage V2.

On the other hand, since the calculation unit 342 can receive the information of the previous image frame (i.e. the voltage V1 or the above-mentioned voltage V1') and the information of the current image frame (i.e. the voltage V2), the calculation unit 342 can also be designed for performing operations like interpolation when the de-interlacing process is performed. Such changes are also included in the scope of the present invention.

Figure 6:
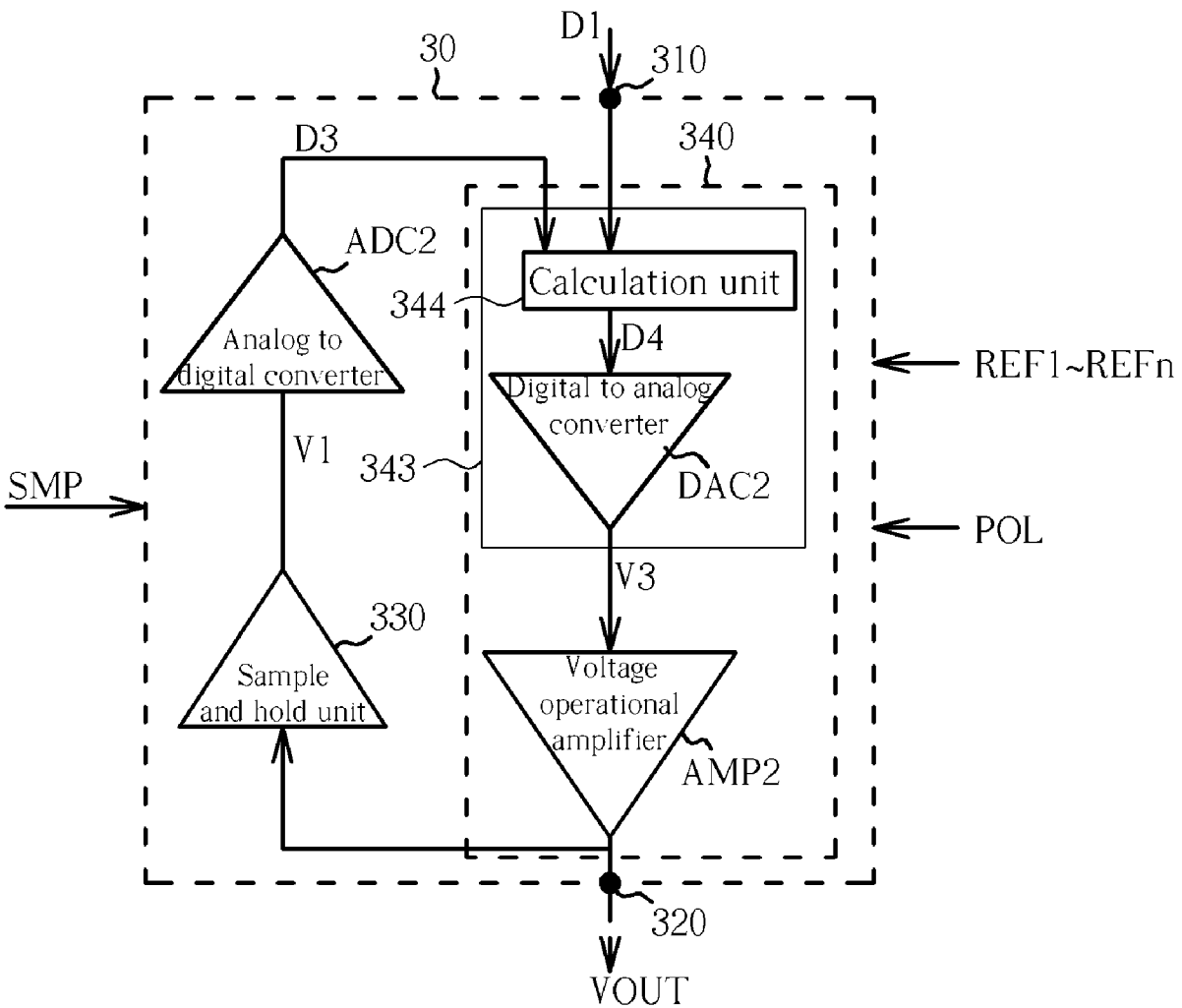
FIG. 6 is a schematic diagram of another embodiment of a data driving circuit of the present invention.

Please further refer to FIG. 6. FIG. 6 is a schematic diagram of another embodiment of the data driving circuit 30 according to the present invention. The data driving circuit 30 can further include an analog-to-digital converter ADC2. The analog-to-digital converter ADC2 is coupled between the sample and hold unit 330 and the driving voltage generation unit 340, and is utilized for converting the sampled voltage V1 outputted by the sample and hold unit 330 to a digital data D3 in digital form according to the reference voltages REF1~REFn. Preferably, the analog-to-digital converter ADC2 can further convert the polarity of the digital data D3 into the same polarity as the video data D1 according to the polarity selection signal POL. Thus, a signal processing module 343 of the driving voltage generation unit 340 can perform the signal processing operations such as over-driving, de-interlacing, motion compensation or frame rate conversion for the video data D1 according to the digital data D3, and can convert a signal processing result D4 into a third voltage V3 in analog form according to the reference voltages REF1~REFn. Preferably, the signal processing module 343 can include a calculation unit 344 and a digital-to-analog converter DAC2, as shown in FIG. 6. Finally, a voltage operational amplifier AMP2 of the driving voltage generation unit 340 can buffer and amplify the third voltage V3 to output the corresponding driving voltage VOUT according to the polarity selection signal POL.

For example, when performing over-driving, the calculation unit 344 can generate the signal processing result D4 according to the following formula: D4=D1+K(D1−D3), among which K can be a predetermined constant or a changing value varying with the video data D1 and the digital data D3.

Compared with the embodiment of FIG. 5 that performing signal processing in analog manner, in this embodiment, the present invention performs the signal processing operation on the video data D1 in digital manner, and since digital signals are more easily used for performing signal processing operations, not only more flexible algorithms can be applied, but also more accurate signal processing result can be obtained.

In the above embodiments, the frame data of the previous image frame (i.e. the voltage outputted by the sample and hold circuit) is provided to the data driving circuit 30 for generating the driving voltages. However, such approaches are merely exemplary embodiments of the present invention, but not a limitation of the present invention. In practical application, the frame data of the previous image frame outputted by the sample and hold unit can be applied to different data processing circuits for performing various image processing tasks, but is not restricted to the above-mentioned data driving circuit 30. Another exemplary embodiment is illustrated in FIG. 7.

Figure 7:
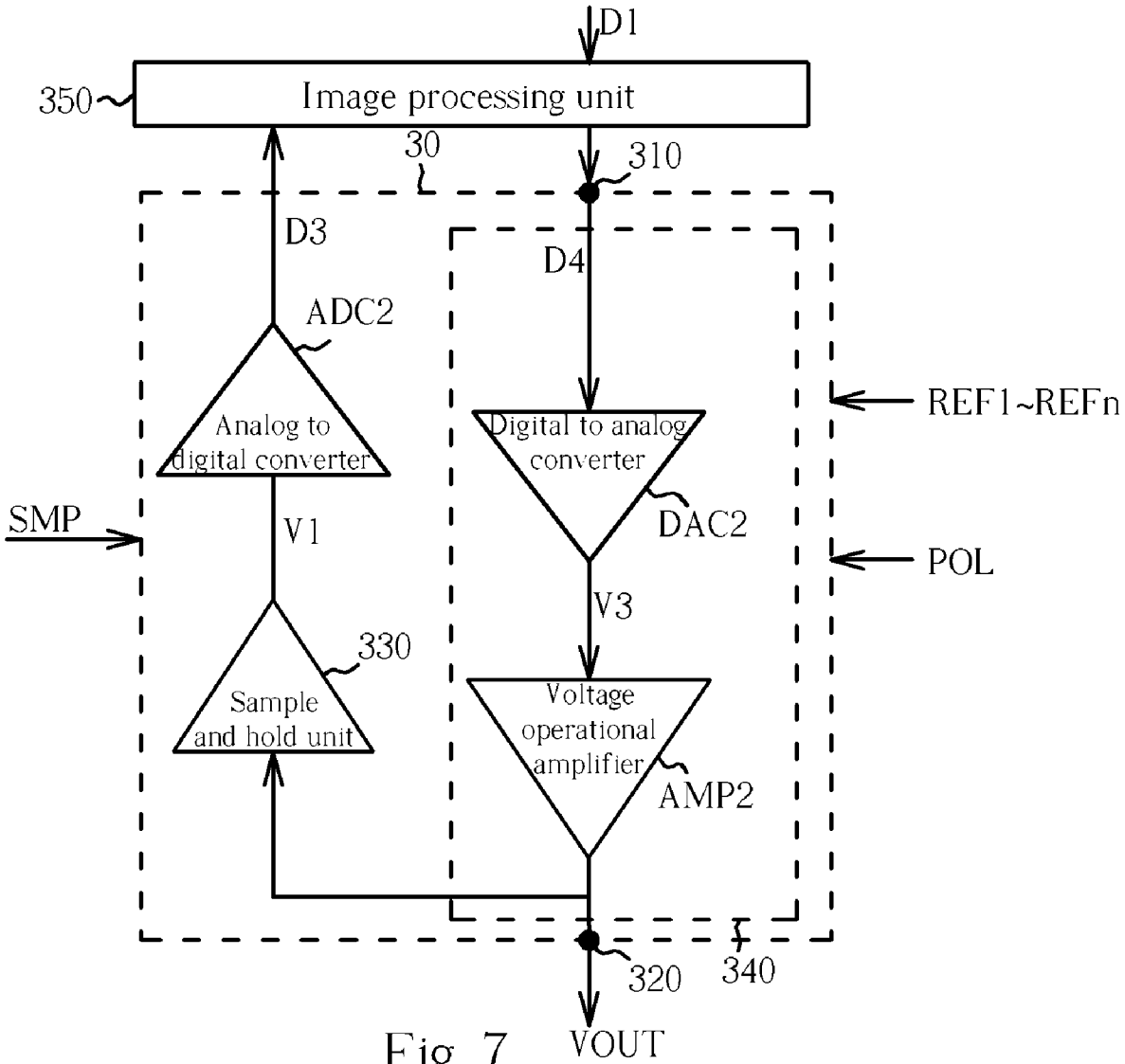
FIG. 7 is a schematic diagram of another exemplary embodiment of the present invention.

As shown in FIG. 7, the sampled voltage V1 outputted by the sample and hold unit 330 represents the frame information of the previous image frame, and thus the digital signal D3 after digitized from the sampled voltage V1 also represents the frame information of the previous image frame. In this embodiment, the digital signal D3 is outputted to an external image processing unit 350, and thus the image processing unit 350 can perform corresponding image processing operations according to the information of the previous image frame (i.e. the digital signal D3) and received information of the current image frame (i.e. the digital signal D1). Therefore, a data driving circuit with the prior art circuit structure can directly generate the corresponding driving voltage VOUT for driving the display panel according to the digital signal D4 outputted by the image processing unit 350, so as further to display corresponding images.

As mentioned above, by reading back the pixel voltages of the display panel of the hold-type display, the present invention can utilize the display panel of the hold-type display as the frame buffer, for improving the problem that the prior art has to utilize extra memory for storing previous frame data. Therefore, the memory demands of the system can be reduced significantly, as well as the cost.

Those skilled in the art will readily observe that numerous modifications and alterations of the device and method may be made while retaining the teachings of the invention.

What is claimed is:

1. A data driving circuit for a hold-type display comprising:

a video data input terminal for receiving video data;

a driving voltage output terminal for outputting a driving voltage to the hold-type display;

a sample and hold unit, coupled to the driving voltage output terminal, for sampling and holding voltages of the driving voltage output terminal to generate a sampled voltage according to a sampling signal; and a driving voltage generation unit, coupled to the video data input terminal, the driving voltage output terminal and the sample and hold unit, for performing a signal processing operation on the video data according to a plurality of reference voltages, a polarity selection signal and the sampled voltage to output the driving voltage;

wherein the driving voltage generation unit converts a polarity of the sampled voltage corresponding to a previous frame according to the polarity selection signal corresponding to the video data of a current frame before performing the signal processing operation on the video data according to the sampled voltage.

2. The data driving circuit of claim 1, wherein the driving voltage generation unit comprises:

a digital-to-analog conversion unit, coupled to the video data input terminal, for converting the video data to a second voltage according to the plurality of reference voltages; and a signal processing unit, coupled to the digital-to-analog conversion unit, the sample and hold unit and the driving voltage output terminal, for performing the signal processing operation on the second voltage according to the polarity selection signal and the sampled voltage after being converted on the polarity of the sampled voltage according to the polarity selection signal to generate the driving voltage.

3. The data driving circuit of claim 1, wherein the sample and hold unit further comprises:

an analog-to-digital conversion unit, coupled between the sample and hold unit and the driving voltage generation unit, for converting the sampled voltage to a first digital data.

4. The data driving circuit of claim 1, wherein the driving voltage outputted by the driving voltage generation unit and then held in the hold-type display is read back to perform over-driving.

5. The data driving circuit of claim 1, wherein the driving voltage outputted by the driving voltage generation unit and then held in the hold-type display is read back to perform de-interlacing.

6. The data driving circuit of claim 1, wherein the driving voltage outputted by the driving voltage generation unit and then held in the hold-type display is read back to perform motion compensation.

7. The data driving circuit of claim 1, wherein the driving voltage outputted by the driving voltage generation unit and then held in the hold-type display is read back to perform frame rate conversion.

8. The data driving circuit of claim 1, wherein the plurality of reference voltages are generated according to a Gamma curve.

9. The data driving circuit of claim 2, wherein the signal processing unit is further utilized for converting the polarity of the sampled voltage according to the polarity selection signal.

10. The data driving circuit of claim 2, wherein the signal processing unit is a voltage operational amplifier.

11. A driving method for a hold-type display comprising:

receiving video data;

sampling and holding voltages of a driving voltage output terminal to generate a sampled voltage according to a sampling signal;

converting a polarity of the sampled voltage corresponding to a previous frame according to the polarity selection signal corresponding to the video data of a current frame;

performing a signal processing operation on the video data to output a driving voltage according to a plurality of reference voltages, a polarity selection signal and the sampled voltage; and outputting the driving voltage to the hold-type display.

12. The driving method of claim 11, wherein the step of performing signal processing on the video data to output the driving voltage according to the plurality of reference voltages, the polarity selection signal and the sampled voltage after being converted on the polarity of the sampled voltage according to the polarity selection signal comprises:

converting the video data to a second voltage in an analog form according to the plurality of reference voltages; and performing the signal processing operation on the second voltage to generate the driving voltage according to the polarity selection signal and the sampled voltage after being converted on the polarity of the sampled voltage according to the polarity selection signal.

13. The driving method of claim 11, wherein the step of sampling and holding the voltages of the driving voltage output terminal to generate the sampled voltage according to the sampling signal further comprises:

converting the sampled voltage into a first digital data according to the plurality of reference voltages.

14. The driving method of claim 11, further comprises:

reading back pixel voltages of the hold-type display to perform over-driving.

15. The driving method of claim 11, further comprises:

reading back pixel voltages of the hold-type display to perform de-interlacing.

16. The driving method of claim 11, further comprises:

reading back pixel voltages of the hold-type display to perform motion compensation.

17. The driving method of claim 11, further comprises:

reading back pixel voltages of the hold-type display to perform frame rate conversion.

18. The driving method of claim 11, wherein the plurality of reference voltages are generated according to a Gamma curve.

19. The driving method of claim 12, wherein the step of performing the signal processing operation on the second voltage to generate the driving voltage according to the polarity selection signal and the sampled voltage after being converted on the polarity of the sampled voltage according to the polarity selection signal further comprises:

converting the polarity of the sampled voltage to a polarity corresponding to the second voltage according to the polarity selection signal.

* * * * *